US005645178A

United States Patent [19]

Conley, Jr.

[11] Patent Number: 5,645,178

[45] Date of Patent: Jul. 8, 1997

[54] METHOD AND SYSTEM FOR STORING AND HANGING ARTICLES

[75] Inventor: Ralph F. Conley, Jr., Miamisburg, Ohio

[73] Assignee: Graph-It, Inc., Miamisburg, Ohio

[21] Appl. No.: 602,109

[22] Filed: Feb. 23, 1996

[51] Int. Cl.[6] ..... A47F 5/08

[52] U.S. Cl. ..... 211/87.01; 211/89.01; 248/490

[58] Field of Search ..... 211/87, 89, 99, 211/104, 106, 118, 119; 248/214, 215, 324, 489, 490, 494, 495, 496

[56] References Cited

U.S. PATENT DOCUMENTS

| | | | |
|---|---|---|---|
| D. 21,870 | 9/1892 | Tucker | 248/489 X |
| 797,208 | 8/1905 | Lehman | 248/490 |
| 1,338,384 | 4/1920 | Loyland | 248/490 |
| 1,770,190 | 7/1930 | Andrews | 211/89 X |
| 1,984,827 | 12/1934 | Derman | 211/87 X |
| 2,042,517 | 6/1936 | Ellis | 211/99 X |
| 2,428,073 | 9/1947 | Handel | 211/87 |
| 2,545,996 | 3/1951 | Graham | 211/104 |
| 2,577,397 | 12/1951 | Bailey | 211/104 X |
| 2,598,614 | 5/1952 | Gilbert | 211/89 X |
| 2,675,130 | 4/1954 | Dore | 211/118 |
| 3,138,359 | 6/1964 | Stewart | 211/87 X |
| 3,211,295 | 10/1965 | Weiss | 211/104 X |
| 4,049,163 | 9/1977 | Stolz | 211/89 X |
| 4,253,577 | 3/1981 | Macfarlane | 211/118 |
| 4,327,837 | 5/1982 | Ross | 211/87 |
| 4,632,285 | 12/1986 | Dillingham | 223/88 |
| 4,722,648 | 2/1988 | Camilleri | 248/489 X |
| 4,834,248 | 5/1989 | Lee | 211/13 |
| 4,863,043 | 9/1989 | Bowen | 211/113 |
| 5,067,621 | 11/1991 | Alexander | 211/117 |
| 5,465,852 | 11/1995 | Koks et al. | 211/87 |

FOREIGN PATENT DOCUMENTS

| | | | |
|---|---|---|---|
| 1098484 | 2/1961 | Germany | 211/104 |

*Primary Examiner*—Leslie A. Braun
*Assistant Examiner*—Sandra Snapp
*Attorney, Agent, or Firm*—Jacox, Meckstroth & Jenkins

[57] ABSTRACT

This invention relates to a method and apparatus for storing and hanging various articles. The storage and hanging system comprises an article receiver which is adjustable secured to a support and which is adjustable to a plurality of different positions such that articles may be hung on one or more rails of the receiver. Subsequently, the article receiver may be collapsed to a closed position so that the stored articles consume a relatively small amount of space. The system is convenient in that it provides a combination of storage containers, and jewelry clips and other clips, along with a mirror which is particularly useful when the system is being used, for example, at a school, office or even during traveling. The system is conveniently designed to be hung on a door or other suitable surface, but it is contemplated that the support for the article receiver may be mounted directly to a surface.

42 Claims, 3 Drawing Sheets

22
46a
46
44
24a
24
C
26
26a
12b
22
44
38
46
2
2
10
40
28
3
3
42
28f
28a
34
28e
28b
36a
48a
32
4
48
12a
28c
4
12
28d
30
B
30
36
36a
16
20
29
A
18
14

METHOD AND SYSTEM FOR STORING AND HANGING ARTICLES

BACKGROUND OF THE INVENTION

1. Field of the Invention

This invention relates to a system and method for storing and hanging various articles, such as ties, jewelry and the like, in spaces which are confining.

2. Description of Related Art

In many temporary and permanent living quarters, such as homes, motels, apartments, condominiums, and the like, there is limited space for conveniently storing articles such as ties, belts, scarves, etc. While there have been many approaches to hanging articles from, for example, a rail, door knob or the like, the prior art designs were deficient because they did not provide a system and method for easily loading such articles in a tiered arrangement which can collapse to permit storing the articles in a relatively small amount of space.

Such prior art systems also fail to provide means for storing jewelry items (such as rings, necklaces, coins and the like) in combination with both a system for hanging and storing clothing articles and a reflective surface for tying ties.

What is needed, therefore, is a convenient and portable system and method for storing and hanging articles in a manner not heretofore known.

SUMMARY OF THE INVENTION

A primary object of this invention is to provide a system and method for storing and hanging articles on an article receiver which can be adjustably moved towards and away from a support surface onto which the receiver is adjustably mounted.

In one aspect of the invention a hanging system comprises a support for hanging on a surface and an article receiver adjustably secured to the support for supporting an article above the ground, the article receiver being adjustably secured to said support such that it can move towards and away from said surface.

In another aspect of the invention this invention comprises a method for supporting a plurality of articles on a door comprising the steps of hanging a support on a top of a door, adjustably securing an article receiver to the support, moving said article receiver from a closed position to an open position and situating an article on said article receiver.

In still another aspect of the invention this invention comprises a hanging system comprising base means for securing the support onto a planar surface, article receiving means adjustably secured to the base means for supporting at least one article above the ground, and latch means for latching the article receiving means in either an open or a closed position.

An object of this invention is to provide a combination mirror and hanging system which is portable and which a user can use while he or she is dressing.

Another object of this invention is to provide a storage and hanging system which utilizes a relative small amount of space.

Still another object of this invention is to provide a combination mirror and article receiver which are both collapsible.

These and other objects and advantages of the invention will be apparent from the following description, the accompanying drawings and the appended claims.

BRIEF DESCRIPTION OF ACCOMPANYING DRAWINGS

DETAILED DESCRIPTION OF THE INVENTION

Figures 1, 2:
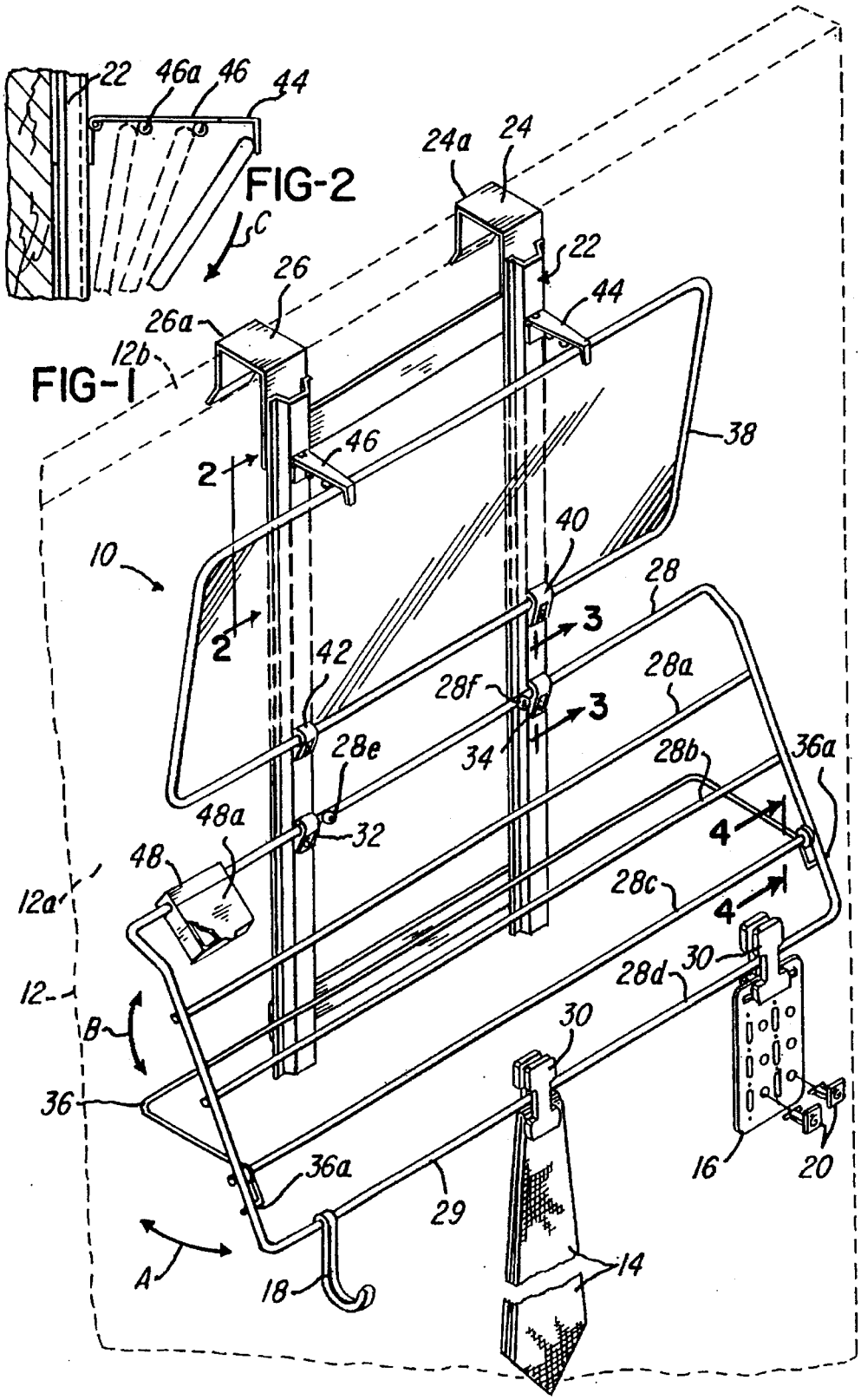
FIG. 1 illustrates a storage and hanging system in accordance with one embodiment of the invention as the storage and hanging system is situated on, for example, a door.
FIG. 2 is a view taken along the line 2—2 in FIG. 1 showing adjustable positions for a mirror used in the storage and hanging system.

Referring now to FIG. 1, a storage and hanging system 10 is shown supported on a planar surface, such as a door 12. The system 10 is suitable for supporting a plurality of articles such as a tie 14, a jewelry support 16 or clothing hook or clip 18 which is suitable for supporting, for example, a hat (not shown) above the ground. The jewelry clip 16 is suitable for supporting jewelry, such as cuff links 20, earrings (not shown) and the like.

The hanging system comprises a support means, base or support 22 for hanging on the planar surface 12. The support 22 comprises a plurality of legs 24 and 26. Notice that the legs 24 and 26 each comprise a U-shaped end **24*a* and 26*a*, respectively. In the embodiment being described, the ends 24*a* and 26*a* are generally U-shaped and comprise a flange 24*b* and 26*b* (FIG. 5), respectively, which facilitates sliding the support 22 onto the planar surface 12**.

In the embodiment being described, the hanging system 10 comprises an article receiver 28 (FIG. 1) comprising a plurality of rails, such as rails **28*a*, 28*b*, 28*c* and 28*d* which are suitable for receiving articles, such as the tie 14 and clip 18. The hanging system 10 may also comprise a plurality of clips 30 which are suitable for holding the tie 14 or even a belt (not shown) in a clothes-pin fashion, as illustrated in FIG. 1**.

Figure 3:
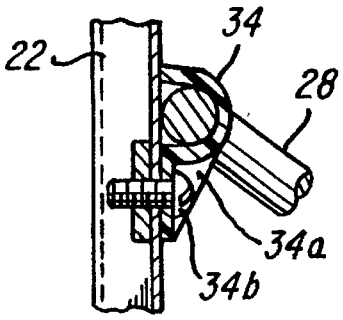
FIG. 3 is a view taken along the line 3—3 in FIG. 1 showing details of the fastening means used for fastening an article receiver to a support in the storage and hanging system.

The hanging system 10 further comprises a pair of fasteners 32 and 34 for securing the article receiver 28 onto support 22 in a manner which will permit the article receiver 28 to pivot in the direction of double arrow A in FIG. 1. Notice that the article receiver 28 comprises a pair of stops **28*e* and 28*f* which cooperate with the fasteners 32 and 34 to reduce or eliminate lateral movement of the article receiver 28 relative to the support 22. As best illustrated in FIG. 3, the fastener 34 comprises a plastic support 34*a* and a screw 34*b* for pivotally securing the article receiver 28 onto support 22**.

Figure 6:
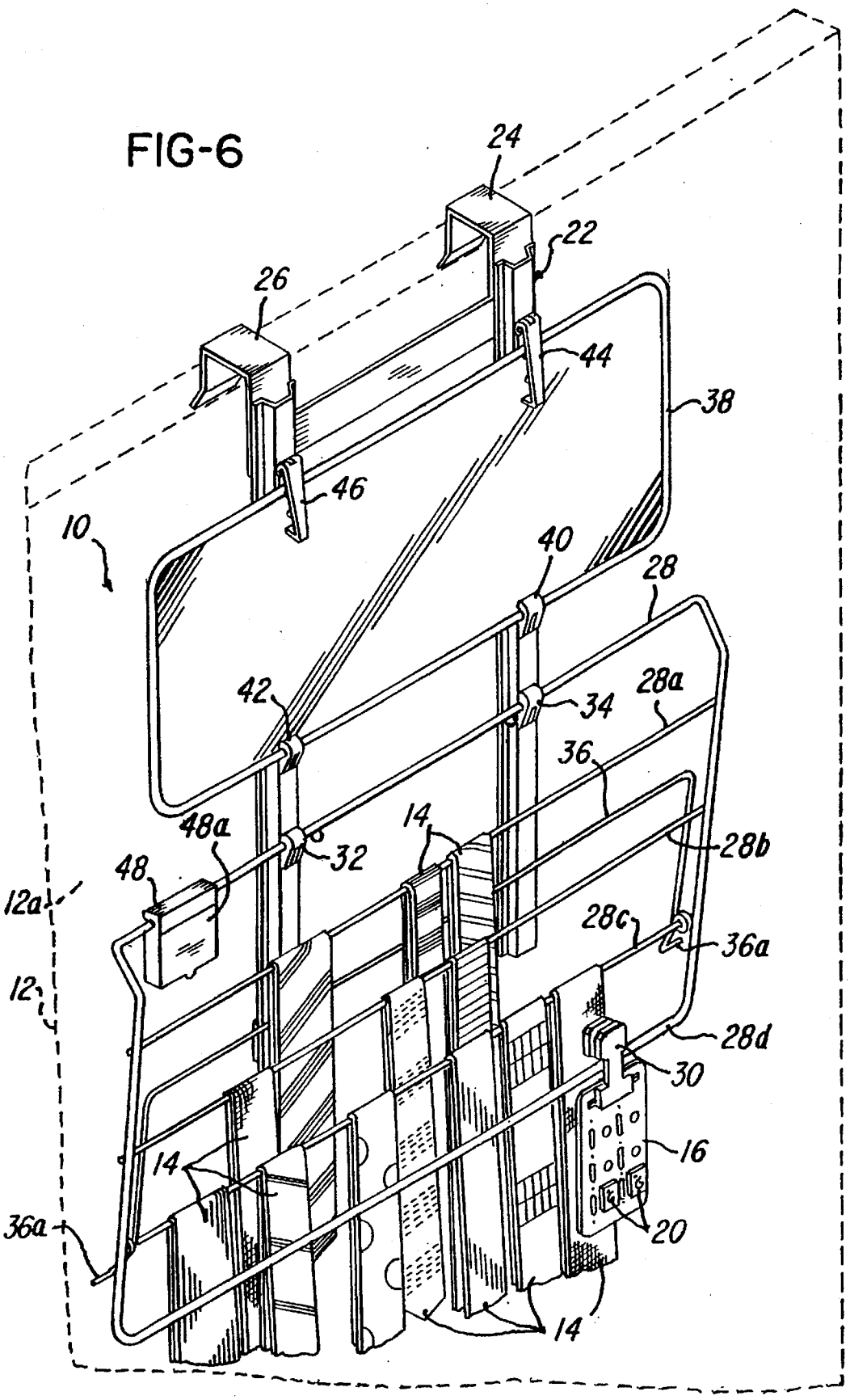
FIG. 6 is a view showing various articles stored and hung while the article receiver and mirror are in a closed position.

The article receiver 28 also comprises a pivoting arm 36 which pivots in the direction of arrow B (FIG. 1) from a closed position (FIG. 6) to the open position shown in FIG. 1. The article receiver 28 cooperates with the support 22 to support the article receiver 28 in the position shown in FIG. 1. Notice that when the support arm 36 is in the down position shown in FIG. 1, the article receiver 28 is supported in the open position such that an end 29 of the article receiver 28 is supported approximately twelve inches away from surface 12. Although not shown, when the arm 36 is in a folded-up position (FIG. 6), the end 29 swings downward toward surface 12 to a folded position (as shown in FIG. 6). This facilitates permitting the article receiver 28 to be situated in the closed position and is supported such that a distance between end 29 and a surface 12*a* of surface 12 is less than three inches.

Figure 4:
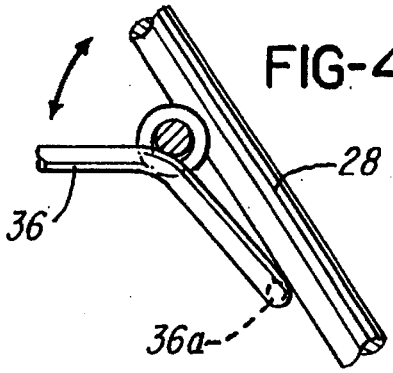
FIG. 4 is a view taken along the line 4—4 in FIG. 1 showing an arm of the article receiver in a down position.

FIG. 4 illustrates the pivoting motion of the arm 36 relative to the article receiver 28. Notice in FIG. 1 that the arm 36 comprises a stop or latch 36*a* for stopping the arm 36 such that the arm 36 lies in a plane which is substantially perpendicular to a plane defined by the support legs 24 and 26. This facilitates providing a rigid support for supporting the article receiver 28 in the open position.

Advantageously, this invention provides means for permitting a plurality of articles to be hung in a tiered arrangement. It should be appreciated that once one or more of the rails 28*a*–28*d* have received one or more articles, the arm 36 may be pivoted or raised to the closed position such that the articles are conveniently stored or hung as illustrated in FIG. 6.

In the embodiment being described, a mirror 38 or other reflective means or device is also pivotally secured via fasteners 40 and 42 to support 22 as illustrated in FIG. 1. Notice that latch means or a latch 44 and 46 are pivotally and hingeably secured to frame 22, as illustrated in FIG. 2. The latch pivots in the direction of arrow C in FIG. 2 to permit the mirror 38 to be secured in a closed position (FIG. 6) or, alternatively in the open position illustrated in FIG. 1. Notice that the latches 44 and 46 comprise a plurality of stops, such as stop 46*a* in FIG. 2, to permit the mirror 38 to be supported in various different positions.

Notice that the mirror 38 conveniently tilts in a variety of tilt angles illustrated in FIG. 2 and is provided such that a user may use the mirror 38 to, for example, tie a tie.

As illustrated in FIG. 1, a box 48 having a lid 48*a* may also be detachably fastened to a rail of article receiver 28 in order to provide a container for receiving jewelry, coins or other small items.

Thus, it should be appreciated that this apparatus provides a convenient storage system for storing and supporting clothing, jewelry, money and the like; however, this invention may be used in other applications, such as for traveling or in an office, school or workplace.

The supports 22 could be provided with more or fewer legs 24 and 26, or could be provided such that the legs 24 and/or 26 may be mounted directly to the surface 12 without the need for the U-shaped ends 24*a* and 26*a*, respectively. This may be achieved by using suitable fasteners such as a screw or by securing a gummed surface (not shown) which will permit the legs 24 and 26 to be mounted directly to a surface, such as a wall or a back of a door.

Figure 5:
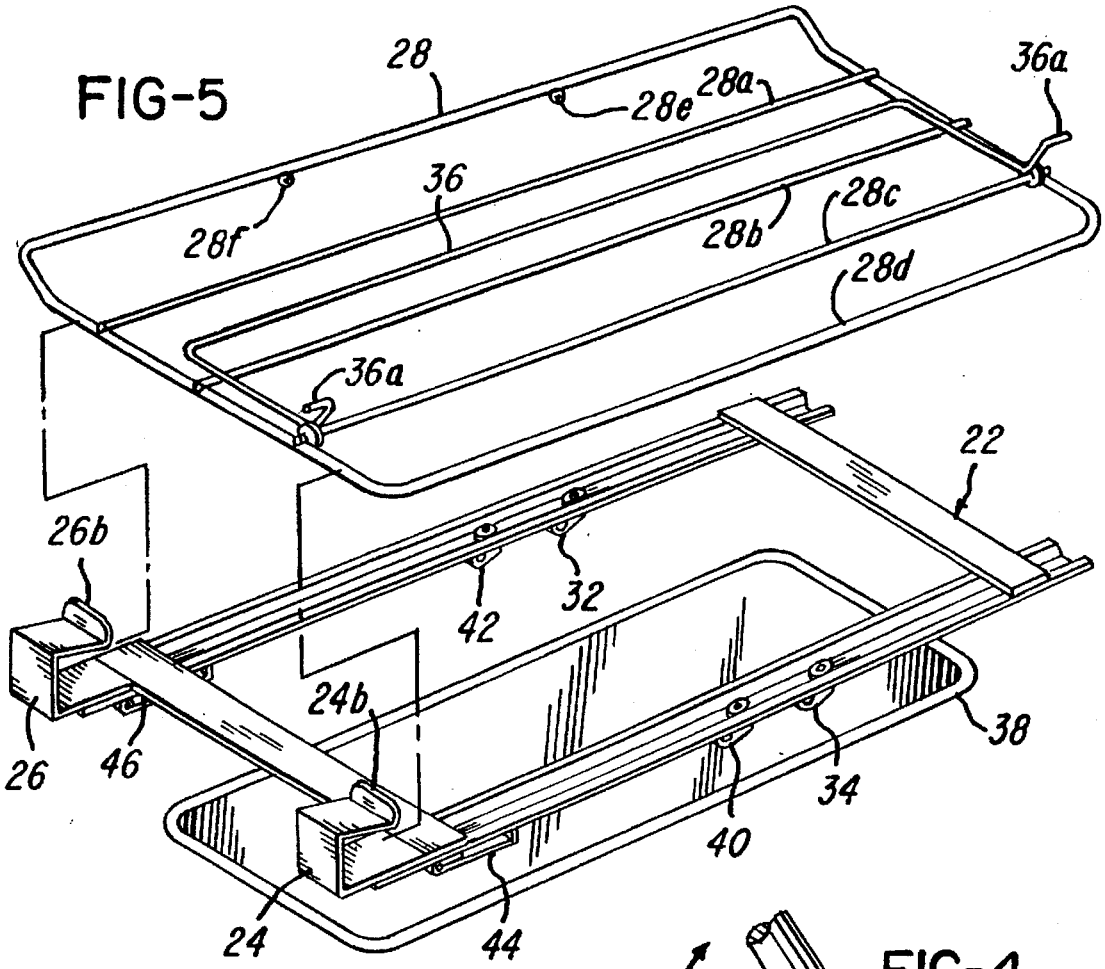
FIG. 5 is a view illustrating the portability and collapsibility of the storage and hanging system.

FIG. 5 illustrates that the hanging system may be disassembled such that the mirror 38, support 22 and article receiver 28 conveniently collapse into a compact and portable arrangement. Although not shown, a strap, rubber band, or suitable clip may be used to retain the components of the hanging system 10 in the collapsed and portable configuration.

A method for using the hanging system will now be described. Initially, the support 22 is situated on surface 12 by sliding ends 24*a* and 26*a*, for example, over a top end 12*b* of the door 12.

Thereafter, the end 29 is moved away from surface 12 such that arm 36 moves or falls into the position shown in FIG. 1, thereby causing the article retainer 28 to be situated in the open, article-receiving, position as shown.

After the various articles have been loaded onto one or more of the rails 28*a*–28*d*, the arm 36 may be moved upward (as viewed in FIG. 1) so that the article receiver 28 moves towards surface 12 and collapses to the closed position, as illustrated in FIG. 6.

In a similar manner, the mirror 38 may be moved towards and away from surface 12 by moving latches 44 and 46 upward (as viewed in FIG. 2) such that the mirror 38 is adjusted. In this regard, it should be appreciated that latches 44 and 46 are preferably formed from a plastic material such that they are resilient enough to permit such movement.

Advantageously, the storage and hanging system of the present invention provides a system and method for hanging various articles in a compact and convenient manner. This is particularly useful when there is limited spaced for such storage or hanging which is commonly the case in many closets, hotel rooms, and the like.

These and other objects and advantages of the invention will be apparent from the following description, the accompanying drawings and the appended claims.

I claim:

1. A hanging system comprising:

a support for hanging on a surface;

a mirror having a bottom edge pivotally secured to said support;

a mirror latch secured to said support at a location above said mirror and having a plurality of downwardly projecting stops, wherein each of said plurality of stops is positioned to hold a top edge of said mirror whereby said mirror is positionable at any one of a plurality of tilt angles relative to said support; and an article receiver adjustably secured to said support for supporting an article above the ground;

said article receiver being adjustably secured to said support such that it can move towards and away from said surface.

2. The hanging system as recited in claim 1 wherein said article receiver is hingably secured to said support.

3. The hanging system as recited in claim 1 wherein said article receiver comprises a plurality of rails.

4. The hanging system as recited in claim 1 wherein said article receiver comprises a plurality of clips for coupling to said article.

5. The hanging system as recited in claim 1 further comprising at least one container secured to said article receiver for supporting a second plurality of articles above the ground.

6. The hanging system as recited in claim 1 wherein said article is either a belt or a tie.

7. The hanging system as recited in claim 4 wherein said plurality of clips comprises a plurality of clothes hangers.

8. The hanging system as recited in claim 1 wherein said support and said article receiver comprise an open position defining a depth of not more than 12 inches.

9. The hanging system as recited in claim 1 wherein said support and said article receiver comprise a closed position defining a depth of less than 3 inches.

10. The hanging system as recited in claim 4 wherein said system further comprises at least one clip card for receiving a third plurality of articles.

11. The hanging system as recited in claim 10 wherein said third plurality of articles comprises at least one tie pin or at least one cuff pin.

12. The hanging system as recited in claim 1 wherein said surface is a door.

13. The hanging system as recited in claim 1 wherein said support comprises a U-shaped end.

14. The hanging system as recited in claim 1 wherein said system further comprises an S-shaped clip for securing to said article receiver.

15. A method for supporting a plurality of articles on a door comprising the steps of:

hanging a support on a top of a door;

providing a mirror having a bottom edge pivotally secured to said support;

providing a mirror latch which is secured to said support at a location above said mirror, said mirror latch having a plurality of downwardly projecting stops;

holding a top edge of said mirror with a first stop of said plurality of stops so that said mirror assumes a first tilt angle relative to said support;

repositioning the mirror so that the top edge of said mirror is held with a second stop of said plurality of stops so that said mirror assumes a second tilt angle relative to said support;

adjustably securing an article receiver to said support;

moving said article receiver from a closed position to an open position; and situating an article on said article receiver.

16. The method as recited in claim 15 further comprising:

pivoting said article receiver from said closed position to said open position.

17. The method as recited in claim 15 wherein said article receiver comprises a plurality of rails, said method further comprising the step of:

situating said article on one of said plurality of rails.

18. The method as recited in claim 15 further comprising the step of:

coupling a plurality of clips to said article receiver.

19. The method as recited in claim 15 wherein said article receiver comprises at least one container secured thereto for supporting a second plurality of articles above the ground; said method comprising the steps of:

opening said container;

situating said second plurality of articles in the container;

closing said container.

20. The method as recited in claim 15 wherein said article is either a belt or a tie.

21. The method as recited in claim 18 wherein said plurality of clips comprise a plurality of clothes hangers.

22. The method as recited in claim 15 further comprising:

pivoting said mirror from a closed position to an open position.

23. The method as recited in claim 15 further comprising the step of:

pivoting said article receiver to an open position defining a depth of not more than 12 inches.

24. The method as recited in claim 15 further comprising the step of:

pivoting said article receiver to a closed position defining a depth of less than 3 inches.

25. The method as recited in claim 15 further comprising the step of:

situating at least one clip card for receiving a third plurality of articles onto said article receiver.

26. The method as recited in claim 25 wherein said third plurality of articles comprises at least one tie pin or at least one cuff pin.

27. The method as recited in claim 23 wherein said method further comprises the step of:

latching said article receiver in said open position.

28. A hanging system comprising:

base means for securing a support onto a planar surface;

a mirror having a bottom edge pivotally secured to said support; and a mirror latch secured to said support at a location above said mirror and having a plurality of downwardly projecting stops, wherein each of said plurality of stops is positioned to hold a top edge of said mirror whereby said mirror is positionable at any one of a plurality of tilt angles relative to said support;

article receiving means adjustably secured to said base means for supporting at least one article above the ground; and an article receiving latch for latching said article receiving means in either an open or a closed position.

29. The hanging system as recited in claim 28 wherein said system further comprises:

said article receiving means comprises a rack having a plurality of rails;

said rack being adjustably secured to said base means such that it swings from an open to a closed position.

30. The hanging system as recited in claim 28 wherein said article receiving means is hingably secured to said base means.

31. The hanging system as recited in claim 28 wherein said article receiver means comprises a plurality of rails.

32. The hanging system as recited in claim 28 wherein said article receiving means comprises clip means for coupling to said article receiving means.

33. The hanging system as recited in claim 28 further comprising at least one container means secured to said article receiving means for supporting a second plurality of articles above the ground.

34. The hanging system as recited in claim 28 wherein said article is either a belt or a tie.

35. The hanging system as recited in claim 32 wherein said clip means comprising a plurality of clothes hangers.

36. The hanging system as recited in claim 28 wherein said support and said article receiving means comprises an open position defining a depth of not more than twelve inches.

37. The hanging system as recited in claim 28 wherein said support and said article receiving means comprises a closed position defining a depth of less than three inches.

38. The hanging system as recited in claim 28 wherein said system further comprises clip card means for receiving a third plurality of articles.

39. The hanging system as recited in claim 38 wherein said third plurality of articles comprises at least one tie pin or at least one cuff pin.

40. The hanging system as recited in claim 28 wherein said surface is a door.

41. The hanging system as recited in claim 28 wherein said support comprises a U-shaped end.

42. The hanging system as recited in claim 28 wherein said system further comprises an S-shaped clip for securing to said article receiver.

* * * * *